US006314626B1

(12) United States Patent
Becker

(10) Patent No.: US 6,314,626 B1
(45) Date of Patent: Nov. 13, 2001

(54) COLLAPSIBLE CASKET

(75) Inventor: Charles R. Becker, New Smyrna Beach, FL (US)

(73) Assignee: Padat, Ltd., New Smyrna Beach, FL (US)

( * ) Notice: Subject to any disclaimer, the term of this patent is extended or adjusted under 35 U.S.C. 154(b) by 285 days.

(21) Appl. No.: 08/876,321

(22) Filed: Jun. 16, 1997

(51) Int. Cl.[7] ..... A61G 17/00

(52) U.S. Cl. ..... 27/4; 27/2; 217/13; 217/65; 220/4.28

(58) Field of Search ..... 27/2, 4, 5, 10, 27/14, 3; 220/4.28, 4.33; 248/220.1; 217/13, 12 A, 12 R, 65

(56) References Cited

U.S. PATENT DOCUMENTS 1,290,057 * 1/1919 Bintliff .
1,610,781 * 12/1926 Hollins ..... 27/4
2,092,697 * 9/1937 Gramelspacher ..... 27/3 X
3,045,314 * 7/1962 Miller .
3,403,641 * 10/1968 Baker ..... 217/65 X
3,879,818 * 4/1975 Rowland .
3,962,761 * 6/1976 Boughner ..... 27/10
3,966,285 * 6/1976 Porch et al. ..... 220/4.28 X
4,041,582 * 8/1977 MacDonald ..... 27/2
4,079,835 * 3/1978 Kendig .
4,123,831 * 11/1978 Covington ..... 27/2
4,209,880 * 7/1980 Lidholm .
4,517,713 * 5/1985 Swallert .
4,800,631 * 1/1989 Pellman .
4,930,197 * 6/1990 McClive .
5,058,248 * 10/1991 Sedlak .
5,121,529 * 6/1992 McClure ..... 27/35 X

* cited by examiner

*Primary Examiner*—B. Dayoan
*Assistant Examiner*—William L. Miller
(74) *Attorney, Agent, or Firm*—Gipple & Hale; John S. Hale

(57) ABSTRACT

A collapsible stackable casket, having: a base member; a plurality of end members and side members removably secured to the base member to form a casket body. A lid assembly is removably mounted to the casket body, the lid assembly defining a lid chamber capable of receiving the base member and end members when the casket is in an unassembled mode.

10 Claims, 4 Drawing Sheets

COLLAPSIBLE CASKET

FIELD OF THE INVENTION

The present invention relates generally to caskets and more particularly to a low cost collapsible stackable burial casket which can be transported and stored prior to use as a highly compact self-contained unit which can be quickly assembled by an unskilled person with simple hand tools when needed for use.

DESCRIPTION OF THE PRIOR ART

The prior art discloses several examples of coffins for use in body burial. One example of coffin art is disclosed in U.S. Pat. No. 4,930,197 issued Jun. 5, 1990. This patent shows a strap system comprised of a plurality of u-shaped metal strap members held in a spaced relationship by a plurality of rods. Side sections are fastened to the straps and held by side blocks and the rods which serve as handles for the coffin.

An example of a collapsible coffin is shown in U.S. Pat. No. 5,058,248 issued Oct. 22, 1991. This patent shows a coffin comprised of a trough assembly and a lid which can be mounted on the trough. All of the elements forming the trough assembly and all of the elements forming the lid are pivotably interconnected to each other by hinges so that these elements can be swivelled down so that they lie in a common plane for facilitating storage and transportation of the coffin. When the coffin is used, the elements are interconnected to each other by means of clamping elements.

U.S. Pat. No. 4,800,631 issued Jan. 31, 1989 is directed to a modular casket which includes a body receiving compartment defined by at least one modular base section having a rectangular base panel and a pair of rectangular side panels hingedly connected to the base panel along longitudinal marginal edges, and a pair of modular end pieces. The base panel, side panels and modular end pieces have mutually cooperable connecting flanges formed thereon which are adapted for selective interconnection to establish a body receiving compartment having an upper peripheral edge on which a modular cover may be mounted. The various modular components are made of lightweight, high strength doubled-walled plastic construction.

Still another example of a foldable coffin can be found in U.S. Pat. No. 4,517,713, issued May 21, 1985 discloses a coffin having a cover, an upper frame, a lower frame, and an inside fitting. The coffin has hinged lateral walls permitting its folding into a storage and transportation position in which its height is a fraction of its extended height. Alternate lateral walls are formed of a single flap hinged on one of the frames, the remaining lateral walls being comprised by two flaps hinged together along a middle line and to each of the frames along a direction parallel to the middle line.

U.S. Pat. No. 4,209,880 issued Jul. 1, 1980 shows a coffin constructed with side walls which are made of a strong corrugated paper material having inwardly turned bottom flaps. The bottom flaps are fixed between an outer bottom plate and an inner bottom plate whose edges abut the inner surfaces of the side walls. Attachment means are provided for mounting foot supports on the under surface of the bottom plate.

Another example of a sectional coffin is found in U.S. Pat. No. 3,879,818 issued Apr. 29, 1995 which discloses a coffin kit comprising a one-piece base or tray, two one-piece side members, two one-piece end members and two one piece lid sections. The tray has raised side and end portions. In assembling the coffin the side and end members are assembled in the tray with their bottom outer surfaces fitting snugly against the raised side and end portions of the tray. The side and end members have mitered ends and when the side and end members are assembled, the adjacent mitered ends fit one against another to form corners. The lid is formed in two identical halves and the lid has the conventional vaulted shape. All of these pieces are made of rigid molded plastic such as self-skinning urethane foam and can be joined together using a conventional epoxy glue that sets over a period of 12 hours.

Another collapsible casket is shown in U.S. Pat. No. 3,045,314 issued Jul. 24, 1992. This patent discloses a casket having a base section split transversely at a point intermediate of the ends to form forward and rear portions of the base. A cover or lid also formed in front and rear portions is positioned on the base. The cover and base have flanges on their respective meeting edges and clamps extend over edges of the flanges of the sections for positively clamping the sections in assembled relation.

U.S. Pat. No. 1,290,057 to Bintliff issued Jan. 7, 1919 discloses a knockdown casket constructed of end plates, side plates, a bottom plate and a cover. All of the members are separate from each other except for the back side plate and cover which are connected at their longitudinal edges by a hinge. The casket is constructed entirely of sheet metal; and the end plates, side plates and the cover are all reinforced by ribs. The end plates and side plates are held in assembled relation with the upright edges of the end plates being folded to form channel flanges which extend inward at right angles and the upright edges of the side plates are bent outward to form flanges with which the end plate flanges slidably interlock. The bottom plate is held interlocked with the side plates by bending the lower longitudinal edges of said side plates outward to form flanges and by bending the longitudinal edges of the bottom plate to form channel flanges which extend upward at right angles thereto. These longitudinal side plate flanges and the bottom plate channel flanges are adapted to be secured in interlocking arrangement by siding the same sidewise sliding movement. The ends of the bottom plate are also bent upward to form flanges which overlap the lower horizontal edges of the end plates.

A review of the prior art shows that while attempts have been made to fabricate readily assembled caskets; these structures have fallen short of meeting the goals of providing an economical casket, that is protected from chipping and scratching easily transported, stacked for storage until ready for use and assembled when needed. The '248 device, for example, has a complicated hinged structure and complex hardware or clamping elements are used to hold the hinged sections together. The '631 modular casket and the '880 coffin are comprised of many parts and a double or even triple walled structure. This modular casket is also preferably fabricated from a plastic such as polyurethane which many potential users object to on aesthetic or environmental grounds. The '197 coffin employs a relatively complex sling or strap system to serve as the main structural support for the device. This is time consuming to assemble and if shipped to the user in assembled form is difficult to store or stack. The '713 coffin has a rectangular embodiment but this structure involves many parts and complex hinging. This coffin incorporates a plurality of rectangular frames and each of the long sides are formed by two hinged flaps. The short sides are only one flap but they are each hingedly connected to one end of one of the frames. The '057 casket is metal and generally requires complicated sheet metal bending and ribbing; as well as being objectionable for aesthetic, environmental and even religious reasons. Similar objections can be raised about the '818 art; it is constructed of a plastic material and the final assembly requires gluing.

The present inventive collapsible stackable casket overcomes these shortcomings and is easily assembled, and can be shipped in a stacked economical compact package.

SUMMARY OF THE INVENTION

A need exists for a low cost collapsible casket that can be stored conveniently in a small space and quickly and easily assembled when needed. Typically these low cost burial caskets are used by governments and churches to bury those who die in poverty or are unclaimed by family or for use in emergencies which result in many deaths in one place at one time. Consequently these institutional purchasers buy collapsible caskets in large quantities and typically need to store them in large quantities until they are needed. Although some attempts have been made to meet this need for low cost caskets, no casket in the prior art has had the right combination of low cost, compact shipping and storage, simple construction, easy assembly and dignified appearance. Prior attempts to devise and build a low cost burial casket have resulted in caskets made of unsuitable materials such as molded plastic or metal, caskets with many parts, caskets that are heavy and difficult to package and store in the unassembled configuration and caskets which are too expensive. Caskets have traditionally been bulky, large, and heavy; which has led to storage problems for users. The casket of the present invention solves these problems and provides institutions with a convenient, high quality alternative to caskets which had previously been available to them. The casket of the present invention in its assembled configuration has a simple yet dignified appearance due in part to the wooden construction and design. This casket has a wooden lid body made entirely of wood in the preferred embodiment which is held together with screws and other simple hardware. The assembled body has two long sides which serve a dual purpose in the device. The inventive collapsible stackable casket of the present invention has a simple construction yet it is structured so that all of the parts of the unassembled casket except for these two long side walls of the device can be stored in the casket lid for easy shipping and storage. Once these parts are in place in the lid, the side walls of the casket are sized so that they can be secured to the lid to seal these parts inside and form a low profile rectangular box which is easily stored and stacked. When a casket is needed, these side walls are simply removed from the lid, the parts removed from therein and the casket is assembled with simple hand tools in a few minutes.

Therefore, it is an object of the present invention to provide a low cost collapsible casket which can be easily assembled when needed.

It is another object of the present invention to provide a casket that is predominantly made of wood and which has a dignified appearance as the final resting place for a human being.

It is yet another object of this invention to provide large volume purchasers with a device that is highly compact in its unassembled configuration and one that can be easily stored, stacked and transported.

Yet another object of this invention is to provide a collapsible casket that can be quickly and easily assembled by a single unskilled person with only a simple hand tool and without glues or complicated hardware.

In the accompanying drawings, there is shown an illustrative embodiment of the invention from which these and other objectives, novel features and advantages will be readily apparent.

DETAILED DESCRIPTION OF THE PREFERRED EMBODIMENT

Figure 1:
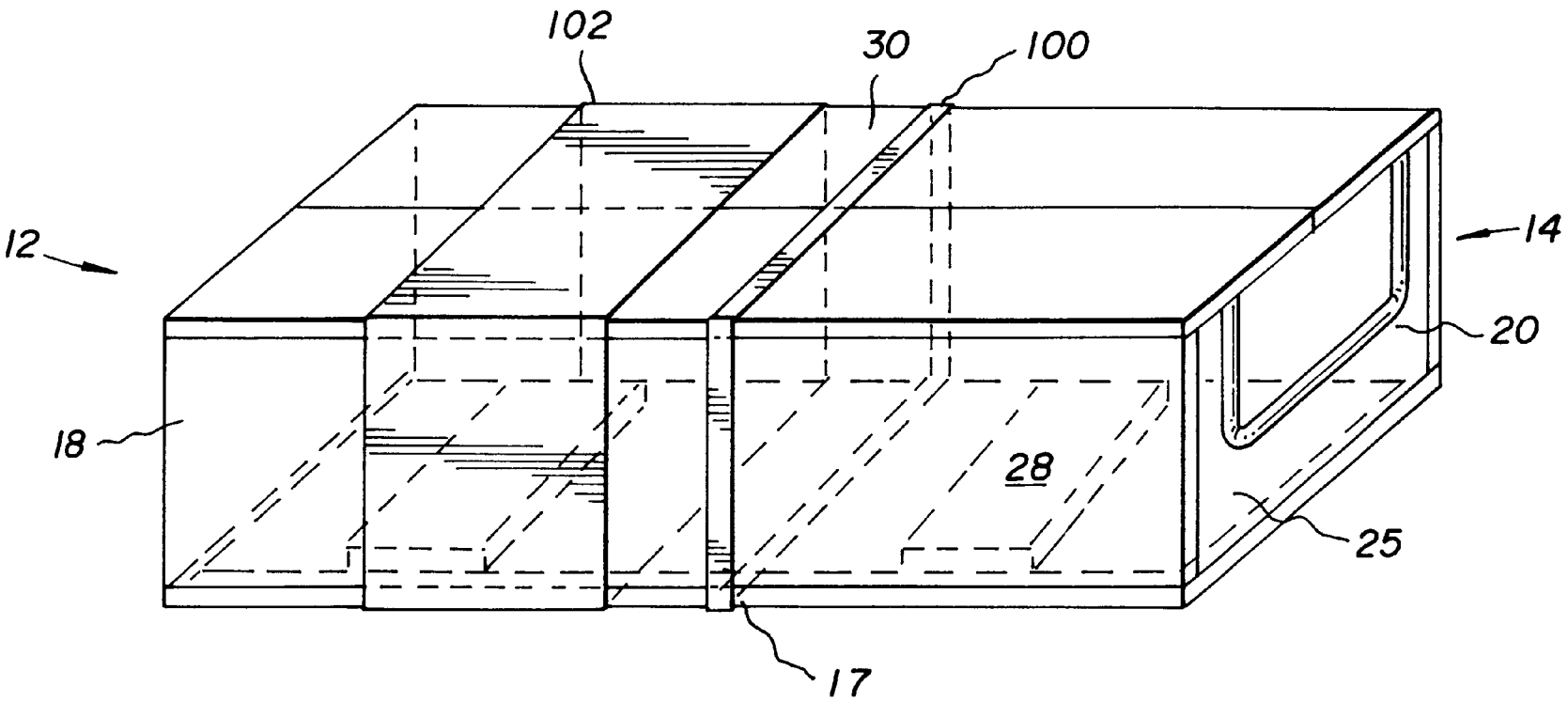
FIG. 1 is a perspective view of the packing configuration of the casket which shows in phantom the base and the ends of the casket stored in the interior of the lid.
Figure 2:
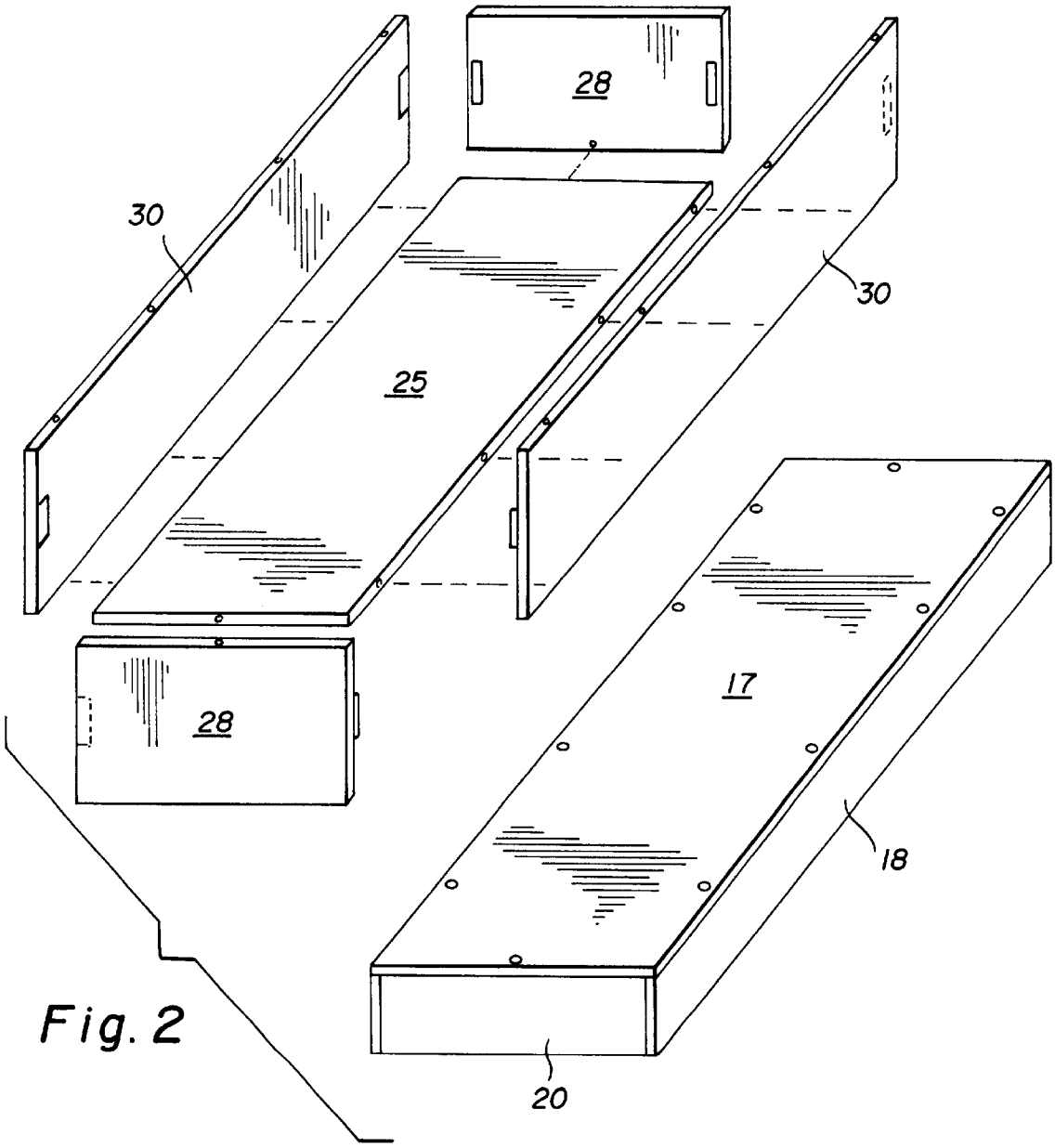
FIG. 2 is an exploded view of the collapsible casket illustrating how the casket pieces are assembled into the finished casket body after they are removed from the packing configuration.
Figure 3:
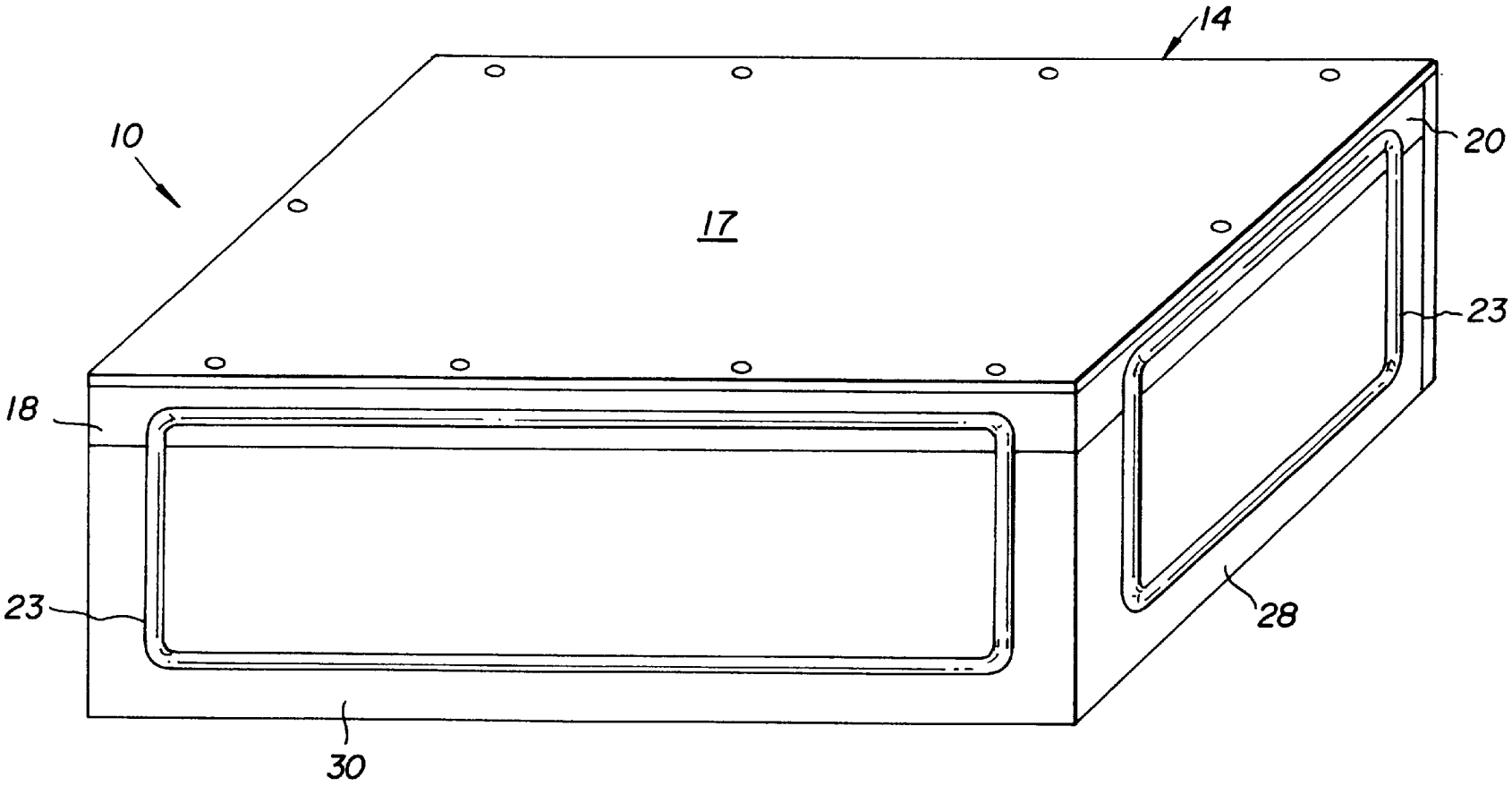
FIG. 3 is a perspective view of the assembled casket showing an optional routed decorative groove in the side wall and end walls of the device.

The best mode and the preferred embodiment of the novel collapsible stackable casket of the present invention is shown generally in FIGS. 1 through 3. FIG. 1 illustrates the casket 10, generally designated, in a collapsed stacked condition 12, also referred to as the packing configuration. This is the configuration the collapsible casket would normally be in when it is transferred to the end user for storage and eventual use. The packed stacked casket assembly 12 is comprised of a lid assembly 14, having a planar top member 17, longitudinal side members 18 and end members 20 each of which is secured to the planar top member 17 by screws or other suitable fasteners. The top planar member 17 is so named because it forms that function in the assembled casket, although it forms the bottom support of the packing configuration. The lid assembly 14 is shipped to the end user fully assembled in this embodiment and is simply turned over and used as a container to store the other casket parts for shipping. The lid sides and ends can have optional decorative routing 23 as shown in FIG. 3.

The base 25 forming the bottom planar member of the assembled casket 10 is stored in the bottom of the lid assembly 14. The pieces that will form the end walls of the body 13 of the assembled casket are stored on top of the bottom planar member 25 in the lid and are generally designated 28. The planar members that will become the longitudinal or side walls 30 of the assembled body 13 are also mounted on the top surface of the side and end members 18 and of the lid assembly 14. If these side walls have decorative routing, the routing is faced inward into the lid assembly chamber. If desired a metal binder 100 can be tightened around the lid and side members or panels to hold the side members on top of the lid. Shrink or stretch plastic wrap 102 could also be used to hold the packing configuration 12 of side members and lid assembly together as well as protecting same.

Hence, the collapsible casket, once it is in the packing configuration, has the same length and width of the casket lid; the height of the casket in the packing configuration being simply the height of the casket lid assembly 14 plus the thickness of an elongated side wall 30. Additionally, this packing configuration is, except for the optional decorative routed grooves in the sides and ends of the lid assembly, a rectangular box which makes transporting and storing the collapsible casket very simple and convenient. The height of the packing configuration 12 is but a fraction of the height of assembled casket 10.

Figure 5:
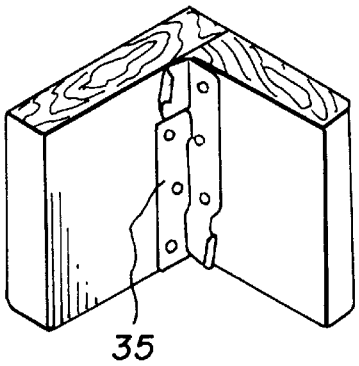
FIG. 5 is a perspective drawing showing the matching pair of corner joint brackets illustrated in FIG. 4 in position holding partial sections of adjacent end and side walls together.
Figure 7:
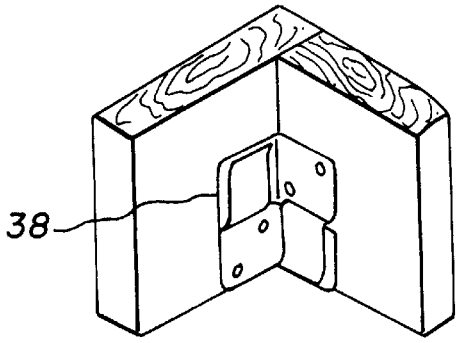

When the end user is in need of an assembled casket, the longitudinal side walls 30 are removed from the bottom of the lid 14 (actually the top of stacked assembly 12)and the base 25 and end walls 28 are removed from the lid 14 and fastened together. The longitudinal side walls 30 are mounted to the end walls 28 by brackets 35. This assembly is shown in FIG. 5. The lid 14 is shipped in a finished configuration and only the body 13 need be assembled. The hardware required to join the side walls 28 and 30 is in the form of brackets 35 and is attached to the interior surfaces of the walls prior to shipping so that the user can join the adjacent side walls together as will be explained below. The general assembly procedure for this embodiment of the collapsible stackable casket is comprised of the following steps: First the user attaches the longitudinal sides 30 to the bottom planar member 25. This is easily accomplished, usually with just a screwdriver because both the longitudinal sides 30 are shipped to the user predrilled to receive wood screws and the bottom planar member 25 is also predrilled and countersunk. Any type of fastener known in the art can be used to attach the longitudinal sides 30 to the planar bottom member 25, as for example nails or staples, but the preferred method is to use a 1.25 inch wood screw. Next, the transverse walls or end walls 28 are inserted down from top to lie flush on the upper surface of base 25 between the two installed longitudinal sides 30 so that the corner brackets 35 which have already been mounted on the inner surfaces of the respective walls interlock and the bottom edge of the end walls 28 contact the upper surface of the bottom planar member 25. These end walls 28, like the longitudinal side walls 30, are predrilled and the bottom planar member is predrilled and countersunk to provide aligned through going bores for mechanical fasteners, in this case the preferred method of attachment being 1.25 inch wood screws.

Figure 4:
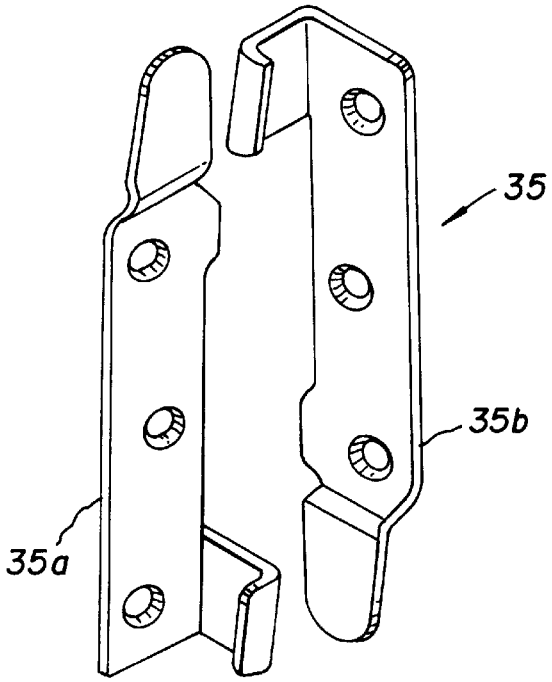
FIG. 4 shows an enlarged perspective view of a matching pair of corner joint brackets which can be used to secure the adjacent sides of the casket together.
Figure 6:
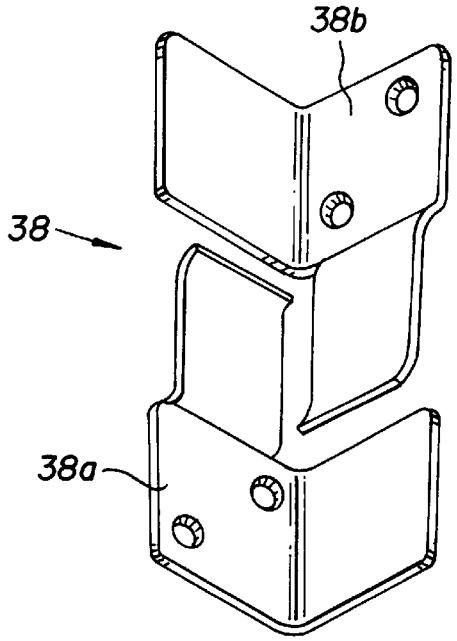
FIG. 6 shows an enlarged perspective view of an alternative embodiment of a matching pair of corner joint brackets which can be used to secure the adjacent sides of the casket together; and, FIG. 7 is a perspective drawing showing the matching pair of corner joint brackets illustrated in FIG. 6 in position holding partial sections of adjacent walls together.

The preferred hardware to use to secure the adjacent side walls 28 and 30 to each other is shown in FIGS. 4 and 5. An alternative embodiment 38 is shown in FIG. 6. FIGS. 4 and 5 show an extra heavy corner joint made of 0.106 inch heavy gauge steel which can be nickel plated or bronze coated. These allow the adjacent side walls of the casket to be securely joined through the wedge action of the corner jointing hardware. As noted, the interlocking parts 35*a* and 35*b* can be attached to adjacent edges of adjacent side walls prior to shipping to the end user. These corner jointing brackets easily attach to the side walls with wood screws. These interlocking parts need no machining and generally only one pair in needed for each corner. If required, the joints can be easily disassembled by reversing the direction of the pressure that was used to install them. Alternatively, the rapid corner joints 38 can be used. Interlocking parts 38*a* and 38*b* work in the same manner as parts 35 and 35*b*. There are made of medium grade steel, typically 0.060 inch thick and may be nickel or statuary bronze coated.

The casket is sealed by placing the lid on the assembled lower body and securing it thereto. Any type of fastener known in the art can be used; although the preferred embodiment uses ten 6.5 inch screws to secure the lid to the casket body. The preferred embodiment of the collapsible stackable casket uses plywood for the bottom planar member, and pine for the ends 30, sides 28 and lid assembly 14. The decorative routing is optional.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present invention as defined by the following claims.

What is claimed is:

1. A collapsible stackable casket, comprising:

a collapsible body assembly with a lid defining an interior recess, said body assembly comprising a rectangular planar base member;

a plurality of elongated rectangular planar side walls having a length substantially equal to the length of said lid and a length greater than said rectangular planar base member;

a plurality of rectangular planar end walls;

means to mount said side walls and ends walls together, said mounting means comprising corner joint brackets secured on the interior of said collapsible stackable casket along an edge of each of said elongated rectangular planar side walls and each of said rectangular planar end walls with each corner joint bracket cooperating with a corner joint bracket on an adjacent side wall to hold adjacent side and end walls together; with said lid when secured to said end walls and side walls sealing said casket, said lid comprising a rectangular planar top me,ember lid end members transversely secured to said top member and side lid members secured to said top member and said lid end members to form said interior recess which can contain said base member and said end walls when in a stacked unassembled condition.

2. A collapsible stackable casket as claimed in claim 1 wherein said end walls, said side walls and said base members are predrilled to receive fastening means.

3. A collapsible stackable casket as claimed in claim 2 wherein said fastening means are screws.

4. A collapsible stackable casket as claimed in claim 1 wherein each elongated side wall is secured to an end wall by a corner joint bracket means.

5. A collapsible stackable casket as claimed in claim 4 wherein said corner jointing bracket means is comprised of two complementary halves, each capable of releasably interlocking with the other.

6. A collapsible stackable casket, in an unassembled stacked closed container comprising:

a base member;

a plurality of end members adapted to be secured to said base members said base member;

a plurality of elongated side members adapted to be secured to said base member and said end members so that said base member, said end members and said elongated side members when assembled forming a casket body;

a lid assembly defining an internal lid chamber capable of receiving and holding said stacked said base member and said plurality of end members therein in an unassembled stacked mode, with said plurality of elongated side members being mounted on said lid assembly to form a stacked closed container.

7. A collapsible stackable casket as claimed in claim 6 wherein said base member, said plurality of end members and said plurality of elongated side members are rectangular and planar.

8. A collapsible stackable casket as claimed in claim 6 wherein said lid assembly, said elongated side members and said end members are predrilled to accommodate a plurality of threaded fasteners to secure said lid assembly to said side and end members.

9. A collapsible stackable casket as claimed in claim 6 wherein said base member is plywood and said end members, side members, and lid assembly are of a different material.

10. A collapsible stackable casket as claimed in claim 9 wherein said different material is pine wood.

* * * * *